US009017015B2

(12) United States Patent
Casavant et al.

(10) Patent No.: US 9,017,015 B2
(45) Date of Patent: Apr. 28, 2015

(54) TURBOMACHINE INCLUDING AN INNER-TO-OUTER TURBINE CASING SEAL ASSEMBLY AND METHOD

(75) Inventors: Matthew Stephen Casavant, Greenville, SC (US); David Martin Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 826 days.

(21) Appl. No.: 13/283,145

(22) Filed: Oct. 27, 2011

(65) Prior Publication Data

US 2013/0104565 A1 May 2, 2013

(51) Int. Cl.
*F01D 11/00* (2006.01)
*F01D 25/26* (2006.01)

(52) U.S. Cl.
CPC ..... *F01D 25/26* (2013.01); *Y10T 29/49229* (2015.01); *F05D 2240/56* (2013.01); *F05D 2240/59* (2013.01); *F01D 11/005* (2013.01)

(58) Field of Classification Search
CPC ..... F05D 2240/55; F05D 2240/57; F05D 2240/56; F04D 29/08; F04D 29/12; F04D 29/122; F04D 29/124; F04D 29/126; F04D 29/128; F01D 9/02; F01D 9/023; F01D 11/00; F01D 11/003; F01D 11/005; F01D 25/24; F01D 25/243; F01D 25/246; F01D 25/265
USPC ..... 415/229, 230, 231, 182.1
See application file for complete search history.

(56) References Cited

U.S. PATENT DOCUMENTS

| | | | | | |
|---|---|---|---|---|---|
| 1,353,082 | A * | 9/1920 | Stehle et al. | ..... | 277/498 |
| 1,447,533 | A * | 3/1923 | Chopieska | ..... | 277/446 |
| 2,638,390 | A * | 5/1953 | Neeme | ..... | 277/451 |
| 4,379,560 | A * | 4/1983 | Bakken | ..... | 277/628 |
| 5,118,120 | A | 6/1992 | Drerup et al. | | |
| 6,079,943 | A * | 6/2000 | Sexton et al. | ..... | 415/115 |
| 6,199,871 | B1 * | 3/2001 | Lampes | ..... | 277/614 |
| 6,315,301 | B1 * | 11/2001 | Umemura et al. | ..... | 277/545 |
| 6,352,267 | B1 * | 3/2002 | Rode | ..... | 277/631 |
| 6,386,548 | B1 * | 5/2002 | Grimanis et al. | ..... | 277/584 |
| 6,431,555 | B1 | 8/2002 | Schroder et al. | | |
| 6,431,825 | B1 * | 8/2002 | McLean | ..... | 415/135 |
| 6,857,849 | B2 * | 2/2005 | Hirst | ..... | 415/135 |
| 6,926,284 | B2 * | 8/2005 | Hirst | ..... | 277/603 |
| 7,128,323 | B2 * | 10/2006 | Iguchi et al. | ..... | 277/644 |
| 7,165,772 | B1 * | 1/2007 | Camacho | ..... | 277/496 |
| 7,527,472 | B2 * | 5/2009 | Allen | ..... | 415/139 |
| 7,788,932 | B2 * | 9/2010 | Kunitake et al. | ..... | 60/797 |
| 2005/0242522 | A1 * | 11/2005 | Lejars | ..... | 277/584 |
| 2010/0237571 | A1 * | 9/2010 | Durocher et al. | ..... | 277/631 |

* cited by examiner

*Primary Examiner* — Dwayne J White
*Assistant Examiner* — Joshua R Beebe
(74) *Attorney, Agent, or Firm* — Cantor Colburn LLP

(57) ABSTRACT

A turbomachine includes an inner casing component having a first end that extends to a second end and a seal member. An outer casing component is coupled to the inner casing component. The annular outer casing component includes a first end portion that extends to a second end portion and a seal element that aligns with the seal member of the annular inner casing component to form a seal passage. A seal is arranged in the seal passage. The seal includes a first end section that extends to a second end section through an intermediate zone. The first end section includes a recessed portion and the second end section includes a connecting portion. The connecting portion is configured and disposed to nest within the recessed portion to form a substantially continuous seal.

18 Claims, 3 Drawing Sheets

TURBOMACHINE INCLUDING AN INNER-TO-OUTER TURBINE CASING SEAL ASSEMBLY AND METHOD

BACKGROUND OF THE INVENTION

The subject matter disclosed herein relates to the art of turbomachines and, more particularly, to a turbomachine having an inner-to-outer turbine casing seal assembly.

Many existing gas turbines include an annular inner casing mounted for radial and axial expansions and contractions relative to an annular outer casing. The annular inner casing is formed from two or more segments joined along bolted flange split lines. Other systems may employ a single piece annular inner casing. The annular outer casing is often formed by two generally semi-circular halves joined along a midline. The annular inner casing supports nozzles and shrouds for the turbine. The annular outer casing supports combustors as well as various ancillary components such as cooling circuits. Thus, the annular inner casing is exposed to a gas stream at a temperature higher than a gas stream passing through the annular outer casing. Exposure to gas streams at different temperatures leads to different expansion rates for each of the annular inner and outer casings.

Due to the different relative rates of expansion of the annular inner casing and annular outer casing, a seal assembly is generally required to reduce leakage. In many systems a series of leaf-type seals are arranged between the annular inner and annular outer casing. The leaf-type seals are arranged in an arcuate end-to-end relationship overlapping sealing areas on the annular inner and annular outer casings. The end-to-end relationship creates intersegment gaps that are configured to accommodate the relative axial expansions and contractions of the annular inner casing relative to the annular outer casing. A cover plate is often provided over the intersegment gaps to further reduce leakage.

BRIEF DESCRIPTION OF THE INVENTION

According to one aspect of the exemplary embodiment, a turbomachine includes an annular inner casing component having a first end that extends to a second end through an inner casing surface, and a seal member. An annular outer casing component is coupled to the annular inner casing component. The annular outer casing component includes a first end portion that extends to a second end portion through an outer casing surface, and a seal element that is configured and disposed to align with the seal member of the annular inner casing component to form a seal passage. An annular seal is arranged in the seal passage. The annular seal includes a first end section that extends to a second end section through an intermediate zone. The first end section includes a recessed portion and the second end section includes a connecting portion. The connecting portion is configured and disposed to nest within the recessed portion to form a substantially continuous seal configured to substantially prevent fluid leakage between the annular inner casing and the annular outer casing.

According to another aspect of the exemplary embodiment, a turbomachine includes a compressor portion, a combustor assembly fluidly connected to the compressor portion, and a turbine portion mechanically linked to the compressor portion and fluidly connected to the combustor assembly. The turbine portion includes an annular inner casing component having a first end that extends to a second end through an inner casing surface, and a seal member. An annular outer casing component is coupled to the annular inner casing component. The annular outer casing component has a first end portion that extends to a second end portion through an outer casing surface, and a seal element that is configured and disposed to align with the seal member of the annular inner casing component to form a seal passage. An annular seal is arranged in the seal passage. The annular seal includes a first end section that extends to a second end section through an intermediate zone. The first end section includes a recessed portion and the second end section includes a connecting portion. The connecting portion is configured and disposed to nest within the recessed portion to form a substantially continuous seal configured to substantially prevent fluid leakage between the annular inner casing and the annular outer casing.

According to yet another aspect of the exemplary embodiment, a method of sealing a turbomachine inner to outer casing interface includes inserting a first end of an annular seal into a seal passage formed between an annular inner and an annular outer turbine casing, guiding the annular seal into the seal passage, and nesting a connecting portion formed at a second end of the annular seal into a recess formed in the first end of the annular seal.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
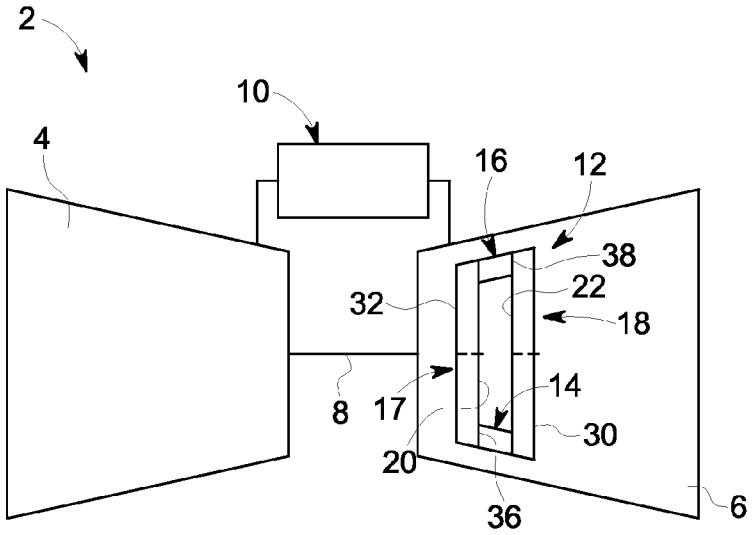
FIG. 1 is a schematic diagram of a turbomachine including annular inner and outer casings having a seal assembly in accordance with an exemplary embodiment.

With reference to FIG. 1, a turbomachine in accordance with an exemplary embodiment is indicated generally at 2. Turbomachine 2 includes a compressor portion 4 operatively connected to a turbine portion 6 via a common compressor/turbine shaft 8. Turbine portion 6 is also fluidly connected to compressor portion 4 through a combustor assembly 10. Air from compressor portion 4 combines with fuel in combustor assembly 10 to form a combustible mixture. The combustible mixture is combusted within combustor assembly 10 to form products of combustion that are delivered to turbine portion 6. The products of combustion expand through turbine portion 6 producing mechanical, rotational, energy that is used in, for example, power generation. Of course it should be understood that turbomachine 2 could be employed in a wide range of applications.

In the exemplary embodiment shown, turbine portion 6 includes an annular casing assembly 12. Annular casing assembly 12 includes an annular inner casing 14 that supports stationary vanes (not shown) connected to an annular outer casing 16 that includes a number of fluid circuits (also not shown) for delivering cooling fluid to portions of turbine portion 6. Annular casing assembly 12 includes a forward portion or upstream end 17 and an aft portion or downstream end 18. Annular inner casing 14 is formed by joining a first annular inner casing component 20 with a second annular inner casing component 22. Each annular inner casing component 20, 22 form half of annular inner casing 14. Similarly, annular outer casing 16 is formed by joining an annular outer casing component 30 with a second annular outer casing component 32. In a manner similar to that described above, each annular outer casing component 30, 32 defines half of annular outer casing 16. In order to limit fluid leakage between annular inner casing 14 and annular outer casing 16 annular casing assembly 12 includes a first annular seal 36 arranged at upstream end 17 and a second annular seal 38 arranged at downstream end 18.

Figure 2:
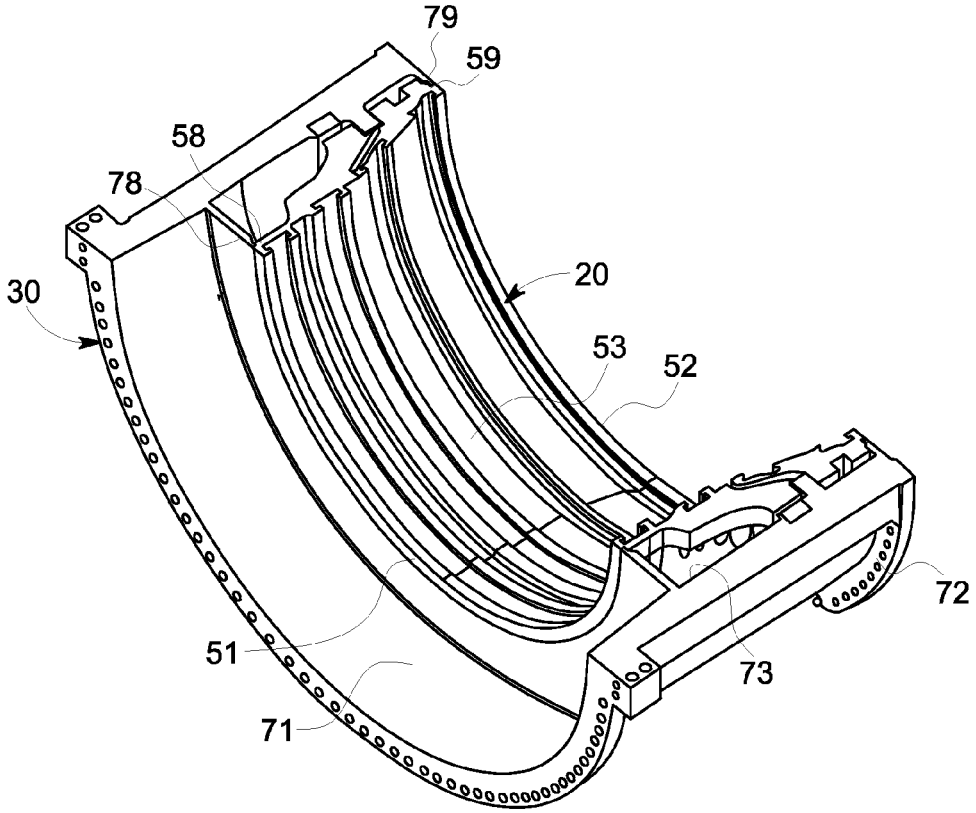
FIG. 2 is a partial perspective view of an annular inner casing component connected to an annular outer casing component forming forward and aft seal passages in accordance with an exemplary embodiment.
Figure 3:
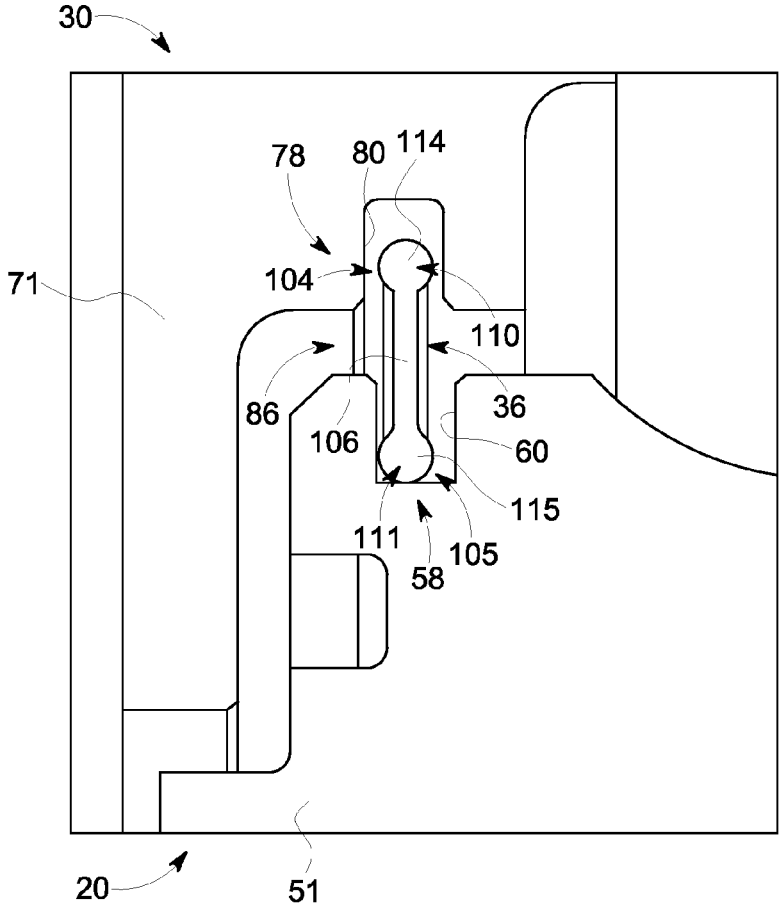
FIG. 3 is a plan view of the forward seal passage of FIG. 2 illustrating a seal in accordance with an exemplary embodiment.

Reference will now be made to FIGS. 2-3 in describing first annular inner casing component 20 and first annular outer casing component 30 with an understanding that second annular inner casing component 22, and second annular outer casing component 32 may be similarly formed. Annular inner casing component 20 includes a first end 51 that extends to a second end 52 through an inner casing body 53. First end 51 includes a first seal member 58 while second end 52 includes a second seal member 59. Each first and second seal member 58 and 59 takes the form of an annular inner groove such as shown at 60 in connection with first seal member 58. Similarly, annular outer casing component 30 includes a first end portion 71 that extends to a second end portion 72 through an outer casing surface 73. First end portion 71 includes a first seal element 78 while second end portion 72 includes a second seal element 79. First and second seal elements 78, 79 take the form of annular outer groves such as shown at 80 in connection with first end portion 71. In accordance with the exemplary embodiment, upon joining annular inner casing component 20 with annular outer casing component 30, first seal member 58 registers with first seal element 78 to form a first annular sealing passage 86. Similarly, second seal member 59 joins with second seal element 79 to form a second annular seal passage (not separately labeled). As will be discussed more fully below, first annular seal passage 86 is configured to receive first annular seal 36 and second annular seal passage (not separately labeled) is configured to receive second annular seal 38.

Figure 4:
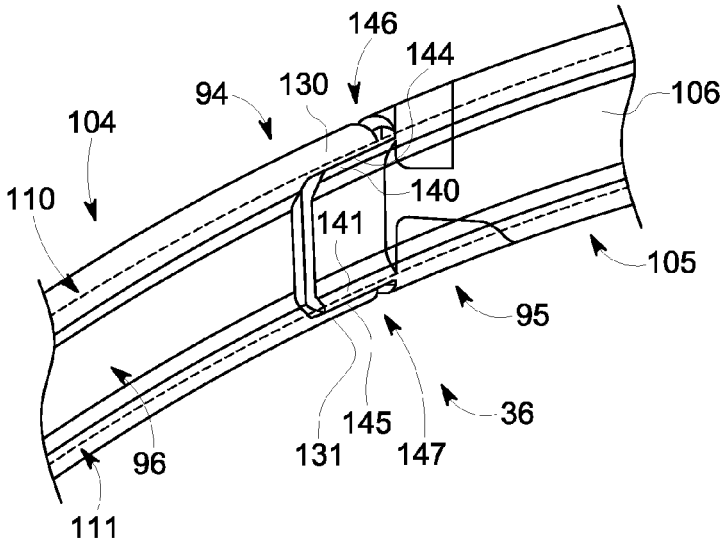
FIG. 4 is a perspective view of first end of the seal connected to a second end of the seal.
Figure 5:
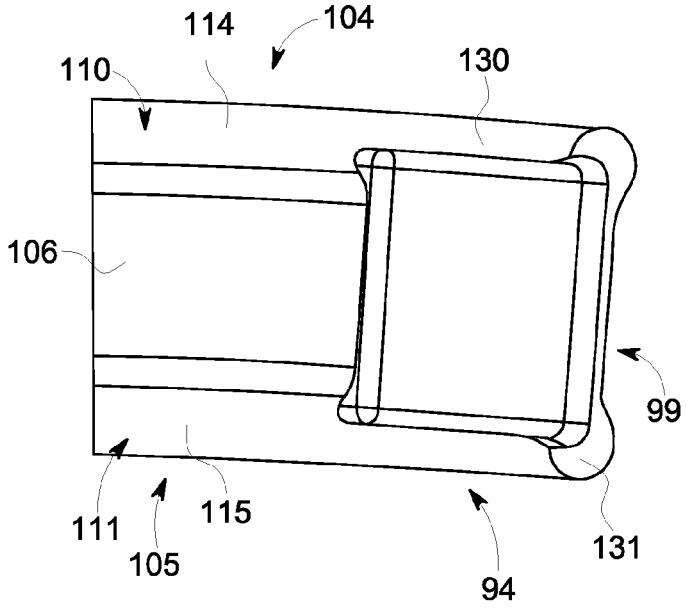
FIG. 5 is a perspective view of the first end of the seal.
Figure 6:
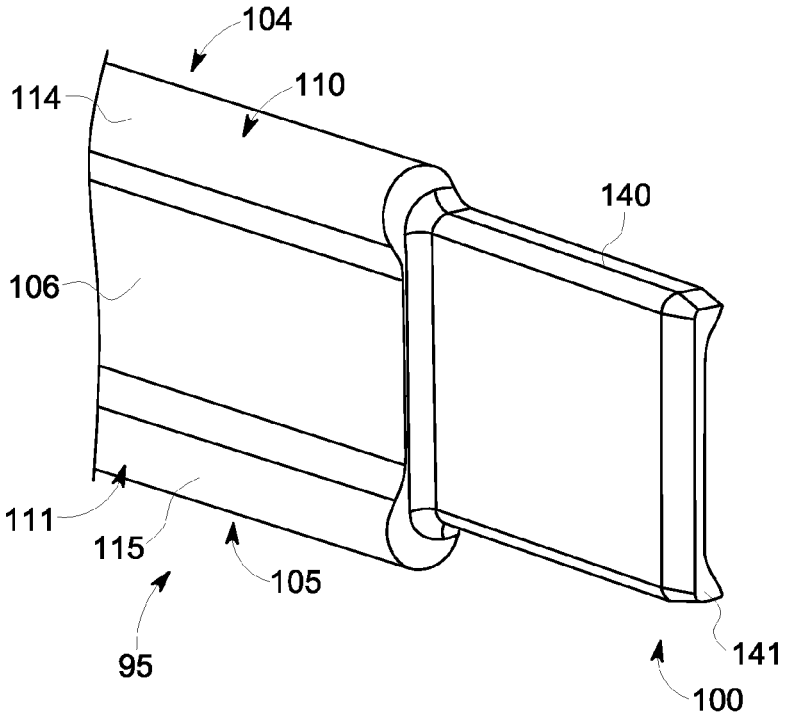
FIG. 6 is a perspective view of the second end of the seal.

Reference will now be made to FIGS. 4-6, in describing first annular seal 36 with an understanding that second annular seal 38 may be similarly formed. First annular seal 36 includes a first end section 94 that extends to a second end section 95 through an intermediate zone 96. First end section 94 is provided with a recessed portion 99 while second end section 95 is provides with a connecting portion 100. As will become more fully evident below, connecting portion 100 is configured to nest within recessed portion 99 to join first end section 94 with second end section 95. At this point it should be understood that first annular seal 36 could be formed from a number of seal segments (not shown). Each seal segment would include corresponding first and second end sections that are joined to adjacent seal segments to form annular seal 36.

In further accordance with the exemplary embodiment, first annular seal 36 includes a first edge section 104 that is joined to a second edge section 105 through an intermediate web 106. First edge section 104 includes a first sealing component 110 and second edge section 105 includes a second sealing component 111 each having substantially circular cross-sections 114 and 115 respectively. First sealing component 110 is configured to seal against a surface (not separately labeled) of first seal element 78 while second sealing component 111 is configured to seal against a surface (not separately labeled) of first seal member 58. Annular seal assembly 36 is configured to float within annular seal passage 86 to accommodate any expansions or misalignments of annular inner casing 14 relative to annular outer casing 16. While shown and described as being substantially circular, other geometries are also possible.

In further accordance with the exemplary embodiment, first end section 94 includes first and second sealing component portions 130 and 131 arranged at recessed portion 99. Similarly, second end section 95 includes first and second sealing component sections 140 and 141 arranged at connecting portion 100. With this arrangement, when connecting portion 100 nests within recessed portion 99, first and second sealing component sections 140 and 141 register with first and second sealing component portions 130 and 131 forming first and second intersegment splits 144 and 145 to substantially complete first and second sealing components 110 and 111 at first and second ends 94 and 95 respectively. In accordance with one aspect of the exemplary embodiment, first and second intersegment splits 144 and 145 fall on contact surfaces (denoted generally by corresponding dotted lines) of first and second sealing components 110 and 111. In addition, when first end section 94 is joined to second end section 95 first and second gaps 146 and 147 are formed at first and second edge sections 104 and 105 respectively. Gaps 146 and 147 allow for radial expansions and contractions of annular seal 36.

At this point it should be understood that the exemplary embodiments describe an annular seal that extends about an interface between an annular inner casing and an annular outer casing of a turbomachine. The annular seal is formed to accommodate axial and radial expansions and contractions of the annular inner casing relative to the annular outer casing. The seal assembly is also formed so as to accommodate any misalignments between the annular inner casing relative to the annular outer casing without compromising sealing effectiveness.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

an annular inner casing component having a first end that extends to a second end through an inner casing surface, and a seal member;

an annular outer casing component coupled to the annular inner casing component, the annular outer casing component having a first end portion that extends to a second end portion through an outer casing surface, and a seal element that is configured and disposed to align with the seal member of the annular inner casing component to form a seal passage; and an annular seal arranged in the seal passage, the annular seal including a first end section that extends to a second end section through an intermediate zone, the first end section including a recessed portion formed in an axial surface of the annular seal, the recessed portion including at least three walls, and the second end section including a connecting portion, the connecting portion extending circumferentially from the second end section and being configured and disposed to nest within the at least three walls of the recessed portion to form a substantially continuous seal configured to substantially prevent fluid leakage between the annular inner casing and the annular outer casing.

2. The turbomachine according to claim 1, wherein annular seal includes a first edge section connected to a second edge section through an intermediate web, the first edge section includes a first sealing component and the second edge section includes a second sealing component.

3. The turbomachine according to claim 2, wherein the each of the first and second sealing components includes a substantially circular cross-section.

4. The turbomachine according to claim 2, wherein the first sealing component is configured and disposed to seal against the seal member and the second sealing component is configured and disposed to seal against the seal element.

5. The turbomachine according to claim 2, wherein the recessed portion is formed in the intermediate web and includes a first sealing component portion and a second sealing component portion.

6. The turbomachine according to claim 5, wherein the connecting portion includes a first sealing component section and a second sealing component section, each of the first and second sealing component sections being configured to mate with corresponding ones of the first and second sealing component portions to form a portion of corresponding ones of the first and second sealing components.

7. A turbomachine comprising:

a compressor portion;

a combustor assembly fluidly connected to the compressor portion; and a turbine portion mechanically linked to the compressor portion and fluidly connected to the combustor assembly, the turbine portion comprising:

an annular inner casing component having a first end that extends to a second end through an inner casing surface, and a seal member;

an annular outer casing component is coupled to the annular inner casing component, the annular outer casing component having a first end portion that extends to a second end portion through an outer casing surface, and a seal element that is configured and disposed to align with the seal member of the annular inner casing component to form a seal passage; and an annular seal arranged in the seal passage, the annular seal including a first end section that extends to a second end section through an intermediate zone, the first end section including a recessed portion formed in an axial surface of the annular seal, the recessed portion including at least three walls, and the second end section including a connecting portion, the connecting portion extending circumferentially from the second end section and being configured and disposed to nest within the at least three walls of recessed portion to form a substantially continuous seal configured to substantially prevent fluid leakage between the annular inner casing and the annular outer casing.

8. The turbomachine according to claim 7, wherein the annular seal includes a first edge section that extends to a second edge section through an intermediate web, the first edge section includes a first sealing component and the second edge section includes a second sealing component.

9. The turbomachine according to claim 8, wherein the each of the first and second sealing components includes a substantially circular cross-section.

10. The turbomachine according to claim 8, wherein the first sealing component is configured and disposed to seal against the seal member and the second sealing component is configured and disposed to seal against the seal element.

11. The turbomachine according to claim 8, wherein the recessed portion is formed in the intermediate web and includes a first sealing component portion and a second sealing component portion.

12. The turbomachine according to claim 11, wherein the connecting portion includes a first sealing component section and a second sealing component section, each of the first and second sealing component sections being configured to mate with corresponding ones of the first and second sealing component portions to form a portion of corresponding ones of the first and second sealing components.

13. A method of sealing a turbomachine inner to outer casing interface, the method comprising:

inserting a first end of an annular seal into a seal passage formed between an annular inner and an annular outer turbine casing;

guiding the annular seal into the seal passage; and nesting a connecting portion formed at a second end of the annular seal into a recess defined by at least three surfaces formed in an axial surface of the first end of the annular seal.

14. The method of claim 13, further comprising: positioning a first sealing component of the seal in a seal member of the inner casing seal against the annular inner casing portion.

15. The method of claim 14, further comprising: positioning a second sealing component linked to the first sealing component, in a seal element of the outer casing to seal against the annular outer casing component.

16. The method of claim 13, wherein nesting the connecting portion into the recess establishes a continuous annular seal.

17. The method of claim 13, wherein nesting the connecting portion into the recess connects a first sealing component portion with a first sealing component section to form a first sealing component at an interface of the first and second ends.

18. The method of claim 17, wherein nesting the connecting portion into the recess connects a second sealing component portion with a second sealing component section to form a second sealing component at an interface of the first and second ends.

* * * * *